United States Patent [19]

Morse

[11] 4,194,370

[45] Mar. 25, 1980

[54] ACCUMULATOR FOR REFRIGERATION SYSTEM

[75] Inventor: Robert L. Morse, Adrian, Mich.

[73] Assignee: Tecumseh Products Company, Tecumseh, Mich.

[21] Appl. No.: 14,967

[22] Filed: Feb. 26, 1979

Related U.S. Application Data

[60] Division of Ser. No. 846,702, Oct. 31, 1977, Pat. No. 4,147,479, which is a continuation-in-part of Ser. No. 714,050, Aug. 13, 1976, abandoned.

[51] Int. Cl.[2] ..... F25B 43/00

[52] U.S. Cl. ..... 62/503; 55/459 R

[58] Field of Search ..... 62/503, 512; 55/462, 55/459 R

[56] References Cited

U.S. PATENT DOCUMENTS

| | | | |
|---|---|---|---|
| 3,796,064 | 3/1974 | Ladusaw | 62/503 |
| 3,837,177 | 9/1974 | Rockwell et al. | 62/503 |
| 4,094,165 | 6/1978 | Sisk | 62/505 |
| 4,111,005 | 9/1978 | Livesay | 62/503 |

*Primary Examiner*—Ronald C. Capossela

*Attorney, Agent, or Firm*—Albert L. Jeffers

[57] ABSTRACT

A mechanical refrigeration system and method of operating the same with a combined hermetic compressor and suction accumulator unit. The compressor includes an electric motor and gas pump driven thereby enclosed within a hermetically sealed first casing having a top wall disposed thereabove in the normal operational orientation of said motor and pump. The accumulator comprises a second casing superimposed on the first casing, of inverted cup shape with the lower edge thereof joined to the first casing such that said first casing top wall closes the lower end of said second casing. Refrigerant fluid from the system suction return line enters the second casing via inlet means oriented to induce a whirling flow of refrigerant fluid in the accumulator casing generally concentric with the upright axis thereof, and a gas liquid-separating standpipe means is disposed within said second casing having a gas outlet extending through said first casing top wall and communicating with an inlet to said gas pump. In the refrigeration system and method, the aforementioned suction accumulator is combined with the hermetic compressor so as to cause heat exchange between the usual compressor components disposed within the first casing and the gaseous and/or liquid phases of refrigerant disposed within the accumulator during flow thereof from the evaporator to the compressor during both the running and shutdown phases of the refrigeration cycle to thereby augment compressor cooling, improve the efficiency of the system and absorb or muffle compressor running noises.

5 Claims, 9 Drawing Figures

FIG. 4
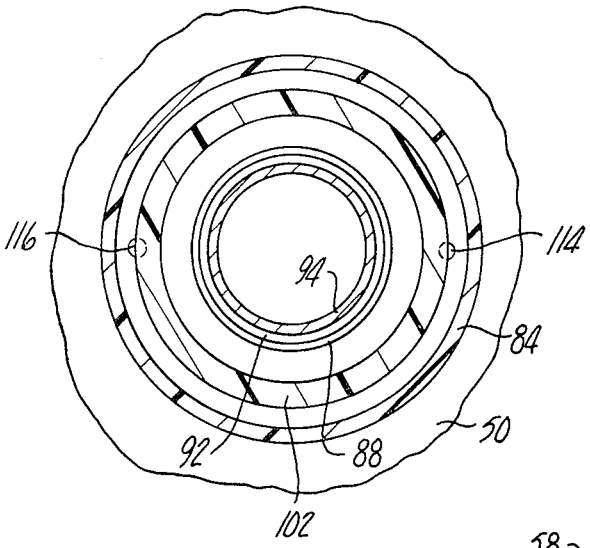
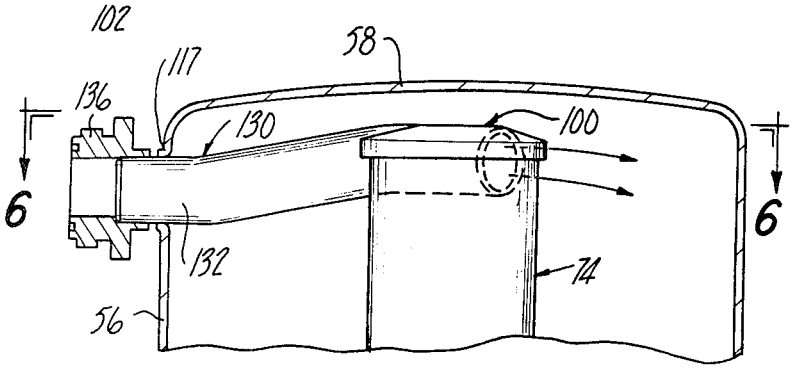
FIG. 5
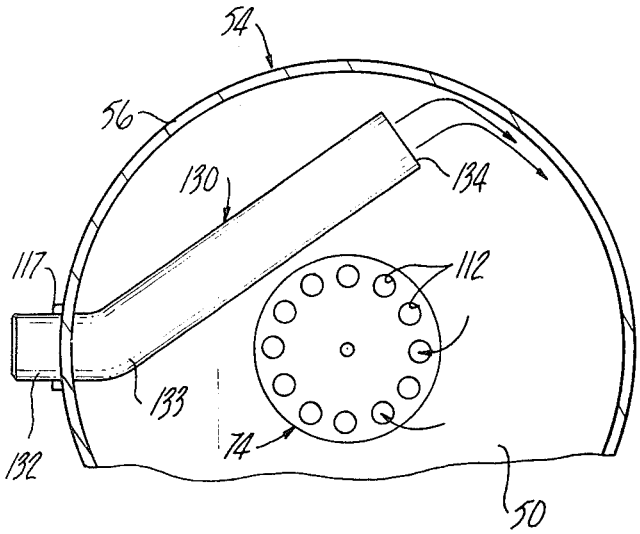
FIG. 6

ACCUMULATOR FOR REFRIGERATION SYSTEM

This is a division of application Ser. No. 846,702, filed Oct. 31, 1977 now U.S. Pat. No. 4,147,479, which is a continuation-in-part of application Ser. No. 714,050 filed Aug. 13, 1976 now abandoned.

The present invention relates to refrigeration systems and cycles employing mechanical compressors, such as air conditioning systems, heat pump systems and the like, and is particularly concerned with a novel method and means for accumulating liquid refrigerant between the compressor and the evaporator of such a refrigeration system.

Among the objects of the present invention is the provision of a refrigeration system and method, and improved apparatus for use in the same, in which a suction accumulator is combined with the hermetic compressor of the system in a manner to cause heat exchange between the usual motor and gas pump components disposed within the hermetically sealed casing of the compressor and the gaseous and/or liquid phases of refrigerant disposed within the accumulator during flow thereof from the evaporator to the compressor during both the running and shutdown phases of the refrigeration cycle to thereby augment compressor cooling, improve the efficiency of the system and absorb or muffle compressor running noises.

Another object is to provide an improved suction accumulator for use in the aforementioned systems which is economical to produce, easy to assemble, has a high ratio of liquid retention capacity to total vessel volume, which provides superior liquid retention under unstable conditions; e.g., under suction pressure changes in the system occurring during system reversals and which imparts a minimal pressure drop to gaseous refrigerant flowing from the evaporator to the compressor.

A further object is to provide a combination compressor and suction accumulator unit which affords savings in space, weight and materials, as well as in tooling and production costs.

Further objects of the invention as well as the features and advantages thereof will become apparent from the following detailed description taken in connection with the appended claims and accompanying drawings wherein:

Figure 3:
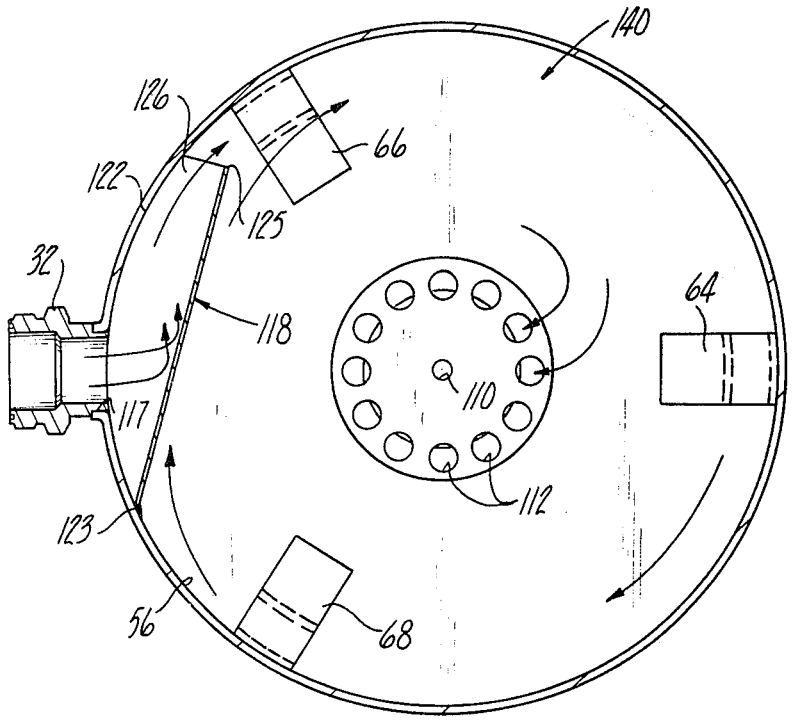
Figure 2:
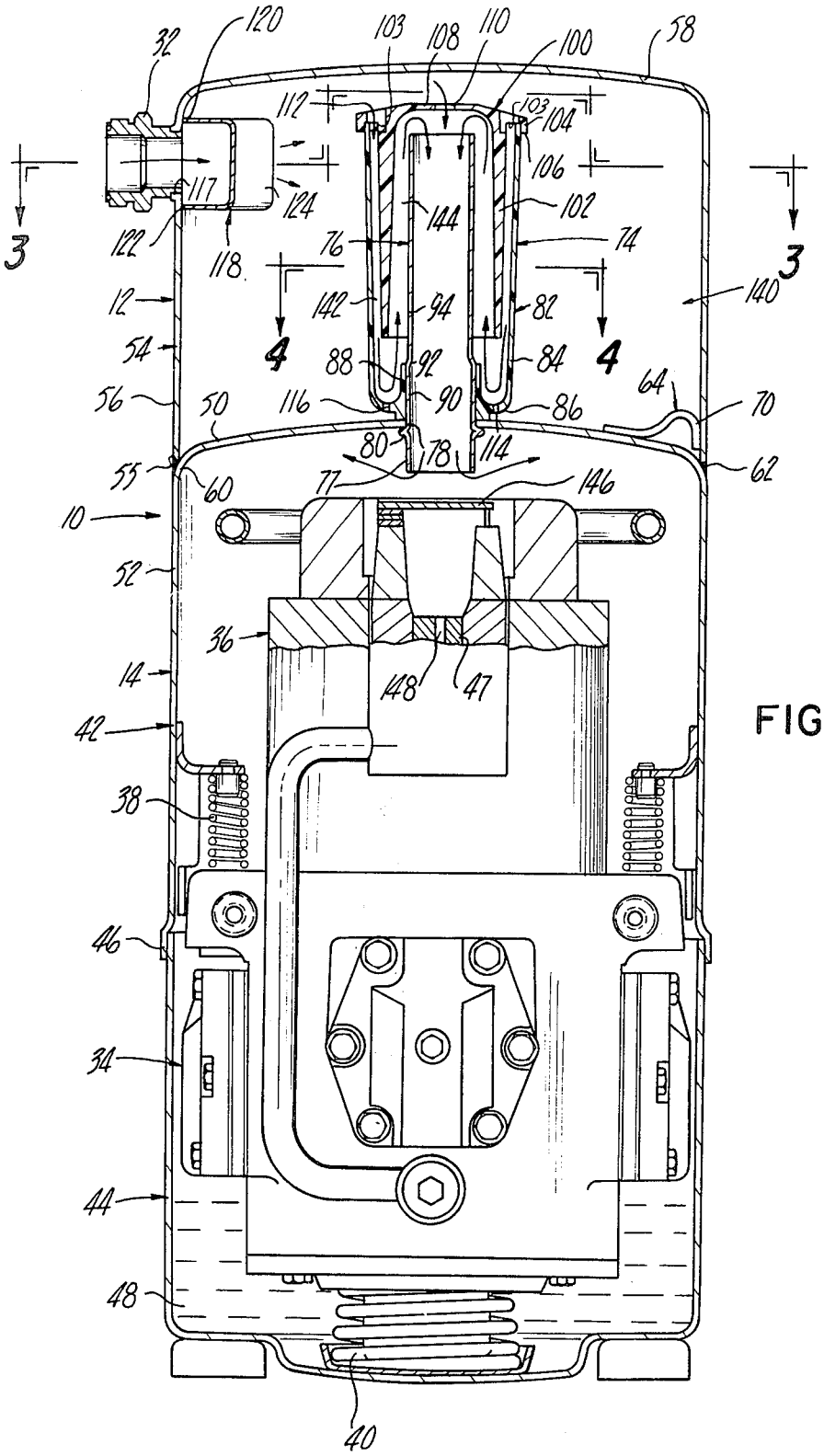
FIG. 2 is a vertical elevational view of the improved compressor-accumulator unit of FIG. 1 shown by itself, the accumulator components and compressor casing being shown in vertical center section and a portion of the compressor motor being broken away.

FIGS. 3 and 4 are horizontal sectional views taken respectively on the lines 3—3 and 4—4 of FIG. 2.

FIG. 5 is a fragmentary view of a modified embodiment of the suction accumulator portion of the unit with the casing thereof shown in vertical center section.

FIG. 6 is a horizontal sectional view taken on the line 6—6 of FIG. 5.

Figure 7:
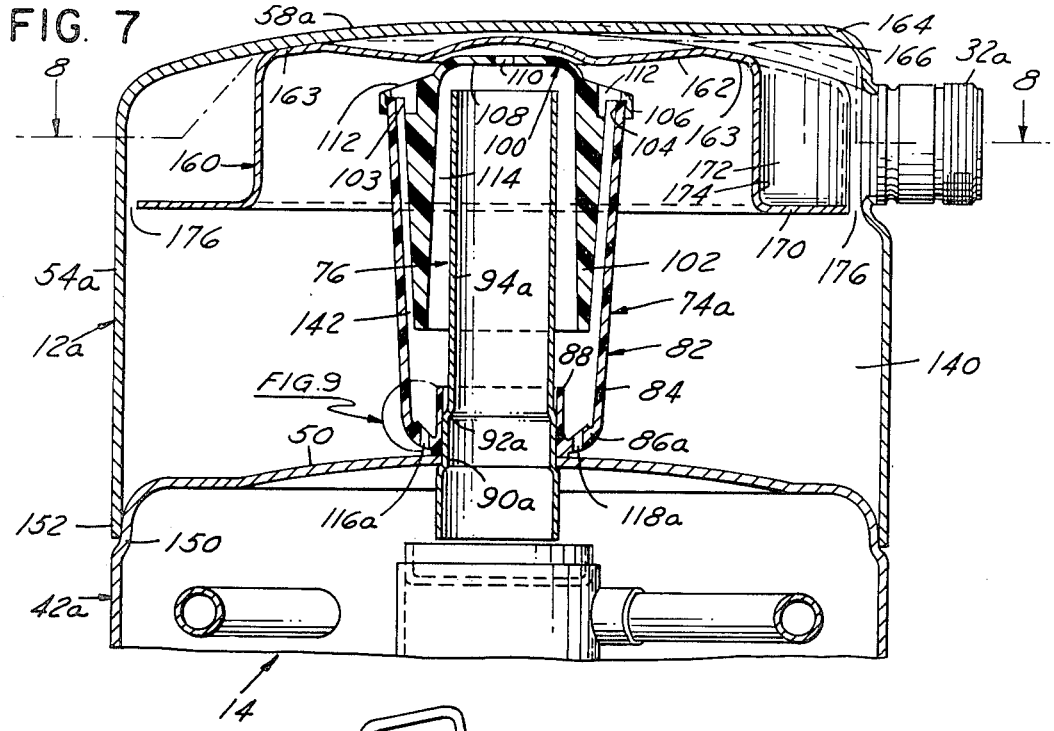

FIG. 7 is a fragmentary sectional view showing an alternative embodiment of the invention taken in vertical bisection.

Figure 8:
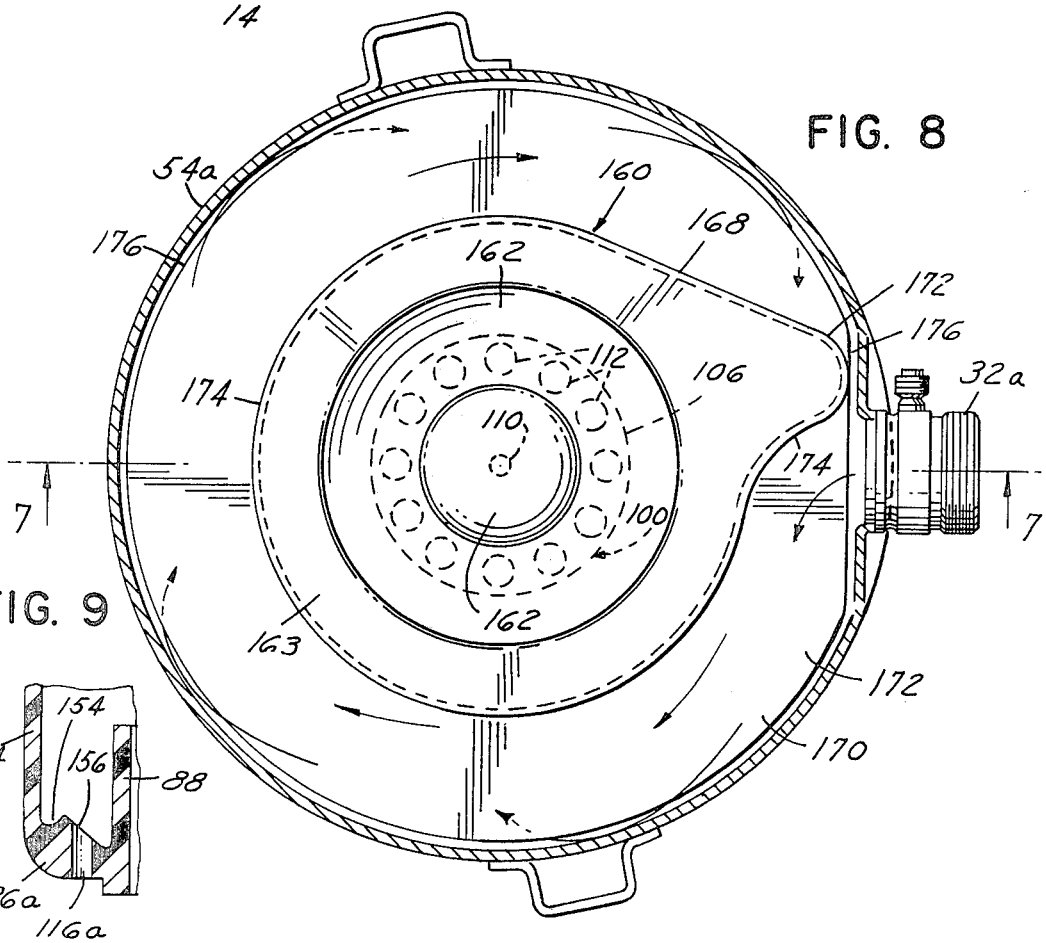

FIG. 8 is a sectional view taken along the line 8—8 in FIG. 7.

Figure 9:
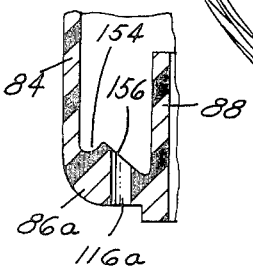

FIG. 9 is an enlarged view of the portion of FIG. 7 indicated by the line 9—9 therein.

Figure 1:
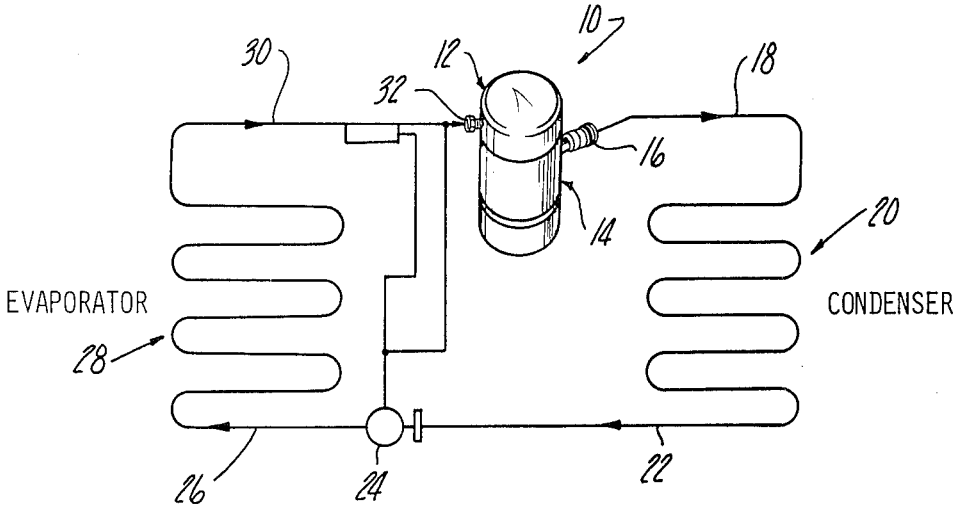
FIG. 1 is a semi-schematic illustration of a mechanical refrigeration system incorporating one embodiment of an improved compressor-accumulator unit of the invention operably connected therein for operation in accordance with the method of the invention.

Referring in more detail to the drawings and particularly to FIG. 1, a mechanical refrigeration system is schematically illustrated in conjunction with an exemplary but preferred embodiment of a compressor-accumulator unit 10 of the present invention. In accordance with one feature of the invention, unit 10 incorporates a complete suction accumulator 12 mounted directly on top of a conventional hermetic compressor unit 14 so as to structurally and functionally integrate these components into a unitary assembly. Compressor 14 thus has the usual discharge conduit outlet fitting 16 connected to a discharge line 18 leading to the coils of a condenser 20 which, in accordance with known practice, may be cooled by fan-driven air or water cooled. A discharge fluid conduit 22 connects the outlet of the condenser to an expansion valve 24 or other conventional pressure reducer. Valve 24 is connected via line 26 to the coils of an evaporator 28, which likewise may be provided with a fan (not shown) or the like for moving air or other heat exchanging fluid over the evaporator coils in accordance with known practice. The discharge outlet of the evaporator is connected via a suction line 30 to an inlet fitting 32 of the accumulator 12.

The details of the construction of the compressor-accumulator unit 10 are best seen in FIGS. 2, 3 and 4. The compressor component 14 of unit 10 preferably comprises a conventional hermetic compressor consisting of a gas pump 34 driven by an electric motor 36 mounted thereon, these components being resiliently supported by suitable spring supports 38 and 40 in a two-piece hermetically sealed casing 42-44. In accordance with conventional practice, the casing consists of an upper half shell 42 and a lower half shell 44 each stamped and drawn from sheet steel, telescopically overlapped at their open ends and welded at 46 to form a hermetically sealed joint. With the particular model of compressor 14 shown by way of example in FIG. 2, the crankshaft, motor shaft 47 and the major longitudinal axis of the casing are oriented upright, as illustrated in FIG. 2, and the lower half 44 of the casing provides an oil sump 48 in accordance with conventional practice. Also, in the preferred embodiment, compressor 14 is of the low-side-casing type; i.e., the interior space of the casing surrounding the compressor communicates freely with the suction inlet of the gas pump 34. The top wall 50 of the compressor casing has the usual convex or dome shape and the side wall 52 of the upper casing 42 is preferably cylindrical or eliptical in configuration. Compressor 14 also includes all of the additional components normally found in a complete hermetic compressor, and it is to be understood that preferably the same can be manufactured and sold as a conventional compressor unit without the additional accumulator unit 12, thus further reducing production costs.

In accordance with a principal feature of the present invention, the suction accumulator 12 is designed as a factory installed, add-on, top-mounted component to the compressor 14. Thus, accumulator 12 consists of an inverted cup-like casing 54 having a cylindrical side wall 56, preferably with the same thickness and diametrical dimensions as wall 52, and likewise a top wall 58, preferably of the same shape and dimensions as top wall 50. Preferably, casing 54 is stamped and drawn using the same tooling employed in the manufacture of the upper half 42 or the lower half 44 of the compressor casing. Accumulator casing 54 is mounted coaxially with casing 42 with its open lower edge 55 seated on the annular shoulder 60 of casing 42, which forms the transition between side wall 52 and top wall 50, and is securely affixed thereto by a circumferential weld 62 to provide a hermetically sealed joint between casings 54 and 42. Preferably, three identical locator clips 64, 66 and 68 (FIGS. 2 and 3) are each spot welded at one end to top wall 50 at 120-degree intervals therearound. The free end 70 of each clip 64, 66, 68 of U shape to provide downwardly directed terminal portions oriented flush with the inner surface of wall 56. Clips 64-68 thus serve as locators to facilitate initial assembly of casing 54 onto casing 42, casing 54 being slipped open end first downwardly past the clips into its correctly seated location on shoulder 60, the clips then maintaining this orientation of casing 54 during formation of the weld joint 62.

Accumulator 12 also includes a gas outlet structure in the form of an upright standpipe assembly 74 disposed centrally within casing 54 and concentrically with compressor 14. Standpipe assembly 74 consists of a generally cylindrical upright metal tube 76 open at its upper and lower ends. Tube 76 is inserted upwardly through a mating opening 78 in the center of compressor top wall 50 with a close clearance fit until an annular external upset rib 80 of tube 76 abuts the undersurface of wall 50 to thereby vertically position the tube. A silver solder joint is then formed between the outer surface of tube 76 and wall 50 to securely support tube 76 and seal the opening 78.

Standpoint assembly 74 also includes an upright cup 82 having an upwardly and outwardly diverging conical side wall 84 and a bottom wall 86 which is integrally joined to a central cylindrical sleeve portion 88. Sleeve 88 is dimensioned to have a shrink press fit on the lower portion 90 of tube 76, tube 76 being reduced in diameter at 92 so that the upper portion 94 of tube 76 has a clearance fit with sleeve 88 to thereby facilitate assembly of cup 82 onto tube 76.

The third component of standpipe assembly 74 comprises a cap 100 with a cylindrical sleeve 102 of tapered section dependent from the underside of the cap so as to extend concentrically into the annular space defined between tube 76 and wall 84 of cup 82 for a distance of at least three-fourths of the height of cup 82. Cap 100 has a groove 103 formed in the underside thereof around the outer periphery of sleeve 102 in which the upper edge of cup 82 is received. A peripheral rib 104 is provided around the upper rim of cup 82 which snaps into an internal undercut in a dependent flange 106 of cap 100 to provide snap-on retention of cap 100 on cup 82. The top wall 108 of cap 100 has a central pressure equalizing aperture 110 and an encircling row of inlet holes 112 (best seen in FIG. 3). Holes 112 provide inlet apertures to the annular space 142 between sleeve 102 and wall 84, and hole 110 vents the upper end of tube 76 to the chamber 140 surrounding standpipe assembly 74. The bottom wall of cup 82 is preferably provided with two diametrically opposed lubricant and/or liquid refrigerant metering orifices 114 and 116 (FIGS. 2 and 4) communicating the lower reaches of cup 82 with the exterior of the standpipe assembly at an elevation slightly above the upper surface of wall 50. Because each orifice is in contact with only a small percentage of cup 82, it has been found by test that two or more equally space orifices on wall 86 provide a more uniform flow through the orifices over the complete operating range of the refrigeration system than a single orifice. The number of orifices selected is based on a desired minimum orifice diameter of 0.090 inches to permit the passing of foreign particles in the system without clogging the orifices, thus eliminating the need for protective screens. The cumulative cross-sectional area of holes 112 exceeds that of inlet fitting 32, and parts 76, 102 and 82 are likewise dimensioned to provide a gas flow path of equal or decreasing cross-sectional area in the direction flow (per the arrows in FIG. 2) to minimize the pressure drop imparted to refrigerant fluid flowing from suction return line 30 to compressor 14 via accumulator 12.

Refrigerant enters accumulator 12 via inlet fitting 32 which is mounted in a flanged opening 117 in the side wall 56 of casing 54 near the top of the accumulator, and which is oriented radially of the casing. A sheet metal channel-shaped baffle 118 (FIGS. 2 and 3) is affixed by welding to the inner surface of wall 56 so as to encompass opening 117. The free longitudinal edges 120 and 122 of baffle 118 are cut to conform to the cylindrical curvature of wall 56, and such that one end edge 123 of the center wall 124 of baffle 118 abuts wall 56 and the opposite end edge 125 is spaced radially inwardly from wall 56, as best seen in FIG. 3. Baffle 118 thus provides a generally tapering throat widening in the direction of fluid flow, and serves to deflect the incoming refrigerant fluid (as indicated by the arrows in FIG. 3) into a tangential flow running circumferentially adjacent wall 56 as the gas leaves the open end 126 of the baffle.

FIGS. 5 and 6 illustrate a modified form of accumulator inlet structure wherein those elements identical to the embodiment of FIGS. 1–4 are given like reference numerals and their description not repeated. In this embodiment, a tube 130 has one end 132 inserted through opening 117 in sealed relation therewith and is bent at 133 (FIG. 6) to extend between wall 56 and standpipe assembly across the head space of casing 54. The open inner end 134 of the tube 130 is directed tangentially toward the inner surface of wall 56 and is spaced a short distance therefrom. A suitable inlet fitting 136 is affixed to the exterior end of tube 130 for coupling the same to line 30. Although inlet tube 130 is somewhat easier to install than baffle 118, the latter has been found to provide an improvement under certain operating conditions and therefore represents the preferred embodiment of accumulator inlet structure.

It is believed that an explanation of the operation of the refrigeration system of the invention equipped with the above-described compressor-mounted accumulator unit 10 of the invention will also serve to explain the method of the invention. Assuming gas pump 34 is running, the pressure differential thereby created between the high and low sides of the refrigeration system causes refrigerant fluid to flow from the compressor outlet 16, through the condenser 20 and evaporator 28 of the refrigeration circuit in the usual manner, and to return to the interior of the compressor casing via accumulator 12. With particular reference to the operation of the accumulator 12, the refrigerant fluid entering reservoir chamber 140 via fitting 32 or 136 may be substantially liquid, substantially gaseous, or a mixture of liquid and gas including some lubricating oil. As indicated by the arrows in FIG. 3, the incoming liquid-gaseous refrigerant mixture is projected by baffle 118 against the confronting cylindrical surface of wall 56 and caused to flow around chamber 140 initially in a generally circular path and then, due to the influence of gravity, in a downwardly helical path. The incoming gases, which move at a relatively high velocity, induce a swirling action of the liquid-gaseous refrigerant. This in turn creates a vortex centrally in the holding chamber or reservoir 140, thereby slinging the heavier liquid portion of the refrigerant toward the outer wall 56 of the reservoir away from the standpipe assembly 74. The lighter, relatively dry refrigerant gas in the vortex area is drawn out of the holding chamber 140 via the cap apertures 112, then flows downwardly via the annular space 142 between sleeve 102 and wall 84, and then reverses direction at the bottom of cup 82. The gas then flows upwardly through the annular space 144 defined between sleeve 102 and tube 76, again reversing direction as it is drawn down into the open upper end of tube 76, and finally exits via the lower end of tube 76 into the upper casing 42 of compressor 14. As illustrated in FIG. 2, in some applications it may be desirable to provide a suitable baffle 146 between the outlet of tube 76 and the crankshaft 47 of gas pump 34 to deflect the incoming refrigerant away from the crankshaft oil pump vent 148 to prevent vapor lock and/or away from the gas pump bearings, as will be well understood in the art.

Due to the liquid-gas centrifugal separation action provided in accumulator 12, the incoming liquid phase of the refrigerant fluid is temporarily retained in the accumulator chamber 140, and the level of this liquid refrigerant in chamber 140 will rise or fall depending upon system conditions. However, the volumetric capacity of chamber 140 is sized relative to the height of tube 76 and the total system charge, including a reasonable over-charge safety factor, to insure that the level of liquid refrigerant never reaches the top of tube 76. During the run mode a metered amount of liquid is withdrawn from chamber 140 into standpipe assembly 74 via metering orifices 114, 116, the velocity of the gas flow being sufficient to pick up and carry this liquid in mist form into tube 76 and thence into the compressor casing. Since the compressor lubricant entrained in the liquid or gaseous refrigerant entering accumulator 12 tends to remain mixed with liquid refrigerant in the bottom of reservoir 140, apertures 114, 116, in conjunction with the pressure differential existing between chamber 140 and space 114, produce a metered flow of liquid refrigerant and lubricant mixture into the gaseous refrigerant stream flowing through standpipe assembly 74, thus insuring that lubricant entrained in liquid refrigerant in chamber 140 is continually fed from the accumulator to the compressor. However, the small amount of liquid refrigerant and/or lubricant thus metered back to the compressor is insufficient to produce a slugging problem in the compressor or to reduce the lubricating qualities of the oil in sump 48.

Once the refrigeration system is shut down (compressor pump 34 shut off), liquid refrigerant tends to enter the accumulator for a period of time, depending upon ambient conditions and system design parameters, just as it would in the case of a conventional accumulator disposed remote from the compressor. However, in the system of the present invention, the liquid refrigerant retained in chamber 140 is disposed in direct heat exchange relationship with the interior of compressor 14 via common wall 50. Thus, the residual motor heat, as well as the heat developed by the usual crankcase heaters (if such are provided in the compressor sump 48), has been found to be effective to gradually boil off the liquid refrigerant during the shutdown phase of the refrigeration cycle. Since the gas flow through the compressor to discharge line 18 is now blocked by the immobile condition of gas pump 34, and since the unit 10 is now warmer than the evaporator 28, the re-evaporated refrigerant will be driven back out of inlet 32, up suction line 30 and into the evaporator coils 28 where it is recondensed and thereafter retained until the system is restarted. Thus, in addition to providing very desirable cooling of the compressor by latent heat of the refrigerant during this re-evaporation process, the top-mounted accumulator 12 operates to provide a quantity of liquid refrigerant in the evaporator which is immediately available on the next system start-up. Of course, there will be an excess quantity of liquid refrigerant in evaporator 28 which will be immediately drawn at high velocity down line 30 toward the compressor, but this excess will be caught and temporarily retained within the accumulator without endangering the compressor. However, the remaining liquid in the evaporator will be effective, as normal system pressure differentials are restored, to evaporate into the gaseous phase in the evaporator. Thus, this reflux refrigerant will start the cooling process immediately at evaporator 28, thus eliminating the normal delays involved in directing gas from the compressor into the condenser coils 20 and then through the expansion valve restrictor 24 into the evaporator coils 28.

For example, in a conventional air conditioning mechanical refrigeration system the time from compressor start-up to system stabilization may require a period averaging five minutes. However, with the system of the invention, this period may be shortened by anywhere from one-half to one minute, which in turn provides a corresponding improvement in the efficiency of the refrigeration system.

In one working embodiment of a compressor-accumulator unit 10 constructed in accordance with the invention the following design parameters were employed:

Type of compressor—Hermetic, four-cylinder radial
Displacement—15.9 cubic inches per revolution
Type of refrigerant—R22
Refrigerant charge—20.5 pounds
Volumetric capacity of chamber 140 to top of tube 76—518 cubic inches
Centerline distance between wall 50 and wall 58—7.00 inches
Diameter of wall 54—10.81 inches
Maximum height of tube 76 above wall 50—5.75 inches
Total cross-sectional area of inlet openings 112—1.81 square inches
Diameter of portion 94 of tube 76—1.31 inches
Diameter of orifices 114, 116—0.117 inches With the above system and apparatus properly charged and operating under conditions of normal to high load air conditioning, superheated gas was observed returning to the compressor and the following values were measured:

Evaporator outlet temperature—55.4° F.
Accumulator inlet temperature—65.4° F.
Compressor oil pan temperature—173.8° F.
Compressor discharge temperature—242.5° F.
Air temperature surrounding compressor—96.0° F.
Ambient temperature surrounding evaporator—75.0° F.

It will be noted in the above example that the temperature of the gas returning to accumulator 12 is ten degrees above the temperature in the evaporator outlet (superheated 10° F.). It has been observed that when the compressor 14 is shut down after running under the above conditions, liquid refrigerant enters accumulator 12 and accumulates in chamber 140 to a depth of about two inches, which represents a retained liquid charge of about eight pounds. After a shutdown period of no more than fifteen hours, it was then observed that accumulator 12 was empty and the level of the oil in the compressor crankcase sump 48 was at a normal level. Thus, the liquid refrigerant initially retained in accumulator 12 after shutdown had been boiled off and recondensed in evaporator 28 due to residual motor heat and operation of the compressor crankcase heaters (immersion type). However, due to the small amount of heat input from the crankcase heaters most of the initial work of boiling the liquid refrigerant out of accumulator 12 is attributable to the transfer of residual heat from the compressor oil, the crankcase casting of gas pump 34 and the motor 36 via wall 50 to the accumulated refrigerant. This example thus demonstrates that accumulator 12 operates as a significant source of compressor cooling at compressor shutdown.

In addition, compressor motor cooling will occur during the running cycle due to the relatively cool refrigerant gas impinging on the top wall 50 of the compressor upper housing 42. Additional cooling is obtained from the increased heat radiating surface area of unit 10 provided by the superimposed casing 54 of the accumulator. Moreover, these system benefits were obtained without sacrifice in compressor performance as demonstrated by comparison tests between the top-mounted accumulator of the invention and a conventional remotely mounted accumulator. The extent of compressor cooling obtained by operation of the compress-accumulator unit 10 will, of course, vary depending upon the heat transfer conditions between the compressor dome 50 and accumulator 12, which in turn are a function of such factors as: (1) area of the compressor dome exposed to the accumulator; (2) thickness and material of the compressor dome; (3) temperature differential between the chamber 140 and the interior space of compressor casing 42-44; and (4) pressure within the compressor-accumulator, which in turn relates to refrigerant density and heat transfer coefficient.

Pursuant to the method of the invention, the above-described reflux refrigerant cooling action can also be obtained in those refrigeration systems wherein the evaporator is located a substantial distance remote from the compressor and condenser components of the system, such as in residential central air conditioning systems, heat pump systems and the like. In such systems, a relatively long suction return line 30 may be employed to connect the evaporator 28 to accumulator 12. In such systems, the liquid refrigerant accumulated in reservoir 140 after system shutdown will be re-evaporated by the heat derived from the compressor components and the refrigerant gas driven back into the suction return line 30, as in the previous example. However, depending upon the distances involved, the relative elevation of the evaporator versus that of the compressor-condenser components of the system, and the differences in the ambient conditions at the two separate locations, the refluxed refrigerant may not recondense in evaporator 28 but rather in suction line 30, such that the suction line rather than evaporator 28 serves as the principal heat transfer element to ambient air for removing soak-out heat of the compressor. If the evaporator is at a higher elevation than the accumulator, the recondensed refrigerant may again return in liquid form to chamber 140. Should sufficient heat remain in the compressor, this refluxing cooling process will continue, either on a continuous basis or periodically, depending on various system conditions. Thus, although the evaporator may not be recharged with refluxed refrigerant during the off-cycle in such systems, the proximity of accumulator 12 to compressor 14 in direct heat transfer relation therewith will still provide the aforementioned benefits of compressor cooling at system shutdown.

Another advantage of the apparatus and system of the invention is the reduction in the sound level observed emanating from the compressor under running conditions. As is well known, much of the audible sound observed externally of the compressor emanates through the top wall of the compressor casing. However, pursuant to the present invention, with accumulator 12 directly superimposed over the top wall 50 of the compressor casing, it has been observed that a sound muffling structure is obtained which is effective to reduce the sound level of the compressor. Moreover, this improved result appears to be enhanced rather diminished when there is a layer of liquid refrigerant in accumulator chamber 140.

Another advantage of the invention resides in the savings in space and weight afforded by the unitary compressor-accumulator assembly 10 as compared to that of an equivalent capacity compressor and a remotely located equivalent capacity accumulator. The invention also provides cost reduction advantages because the accumulator and compressor share a common dividing wall 50, and because the usual connecting tubing required with a remote accumulator installation are eliminated. The use of common tooling to produce casing 54 and casing 42 or casing 44 also results in production savings. The unique design of the standpipe assembly 74 permits cup 82 and cap 100 to be economically mass produced as plastic injection moldings which are readily assembled to one another and onto standpipe tube 76.

Another feature is the extension 77 of tube 76 downwardly from wall 50 a predetermined distance into the head space of casing 42. With this arrangement, should the compressor-accumulator unit 10 be inverted, as may occur during shipping, the portion 77 of tube 76 projecting interiorly of the compressor from wall 50 will serve as a dam to retain at least some of the oil charge in the compressor casing while the remainder overflows portion 77 and drains in accumulator 12. The length of extension 77 is designed such that the oil retained in the compressor casing is sufficient to insure adequate lubrication of the compressor when the same is first started up in a refrigeration system until such time as the balance of lubricant lost into the accumulator during inversion of the unit can be returned to the compressor casing via standpipe assembly 74.

Due to the provision of vent 110 in cap 100, sufficient refrigerant gas is permitted to enter tube 76 directly from vent 110 at compressor shutdown to prevent liquid refrigerant which accumulates in chamber 140 to a level above the lower edge of sleeve 102 from being forced back into the compressor casing while system operating pressure differentials are being equalized. It has also been found that, despite the upwardly convex curvature of the floor 50 of chamber 140, liquid oil does not tend to be trapped in chamber 140 below the level of orifices 114, 116 during running of the compressor. Rather, due to the swirling action of refrigerant gas in chamber 140, the oil tends to be driven upwardly along surface 50 toward orifices 114,116. Thus, unit 10 does not require an increase in the amount of lubricant charge in order to accommodate the add-on accumulator 12.

A second alternative embodiment of the invention is illustrated in FIGS. 7–9, wherein reference numerals identical to those discussed hereinbefore with reference to FIGS. 1–4 indicate identical elements and need not be explained. In the embodiment of FIGS. 7–9, an upper compressor shell 42*a* is provided with an annular recess or indentation 150 around the upper portion thereof, and the accumulator shell 12*a* is elongated cylindrically at the lower portion thereof, and the accumulator shell 12*a* is elongated cylindrically at the lower portion 152 thereof to be received telescopically into recess 150. The requirement for locator clips 64–68 (FIGS. 2–3) is thereby eliminated while at the same time providing for axial and radial location of accumulator shell 12*a* with respect to compressor upper shell 42*a*.

A standpipe assembly 74*a* includes the cap 100 and a cup 82*a* having modified bottom wall 86*a* in the region of the cylindrical oil inlet orifices 116*a*,118*a* which have a preferred diameter in the range of 0.115 to 0.120 inches. More specifically, referring to FIG. 9, lower wall 86*a* includes a circumferentially continuous ramp portion 154 contiguous with and sloping upwardly with respect to cup wall 84. A downwardly sloping circumferentially continuous wall portion 156 extends between portion 154 and sleeve 88, with orifice 116*a* opening onto portion 156. The structure of cup lower wall 86*a* adjacent orifice 118*a* (FIG. 7) is the mirror image of that illustrated in FIG. 9. It has been found that modified lower cup wall 86*a*, coupled with enlarged orifices 116*a*, 118*a*, provides enhanced metered aspiration of lubricant into the refrigerant stream. This is believed to result from the fact that sloping wall portions 154,156 cooperate to deflect refrigerant gas, impinging thereon from passage 142, in an upwardly direction adjacent the inner end of orifices 116*a*,118*a*, as illustrated in part in FIG. 7, and thereby increase the oil suction pressure differential across the orifices.

The alternative embodiment of FIGS. 7–9 also includes an improved inlet baffle arrangement comprising a hat-shaped baffle 160 having a top 162 which is welded around its peripheral edge 163 to the crowned portion of top wall 58*a* of accumulator shell 12*a*. The portion 164 of shell wall 58*a* adjacent the refrigerant inlet fitting 32*a* is not crowned, as best seen in FIG. 7, and thus provides an opening 166 between edge 163 and top wall 58*a* by means of which the central region between baffle top 162 and wall 58*a* communicates with the accumulator interior. Baffle 160 includes a generally cylindrical band portion 168 depending from edge 163 and terminating in a flange or brim 170 projecting outwardly toward casing side wall 54*a*. As best seen in FIG. 8, band portion 168 includes a radially projecting nose portion 172 which is spaced laterally in assembly from the axis of inlet fitting 32*a*, such that refrigerant gas entering inlet 32*a* impinges on a generally concave band surface 174. The radial edges of nose portion 172 and brim 170 are spaced in assembly from the inside surface of shell wall 54*a* to provide a relatively narrow annular space 176 extending 360° between brim 170 and wall 54*a* for passage of refrigerant gas into accumulator chamber 140.

Thus, baffle 160, including nose portion 172 and concave surface 174, cooperates with wall 54*a* to provide a generally annular inlet region bounded by band 168, brim 170 and shell walls 54*a*,58*a* for swirling circulation of entrant gas. Such entrant gas is deflected by surface 174 into a generally circular motion, as illustrated in FIG. 8. Nose portion 172 substantially but not completely closes the end of annular region remote from inlet 32*a* so that entrant gas circulating therein migrates into chamber 140 through space 176 during a single passage around the entrant region. The remaining operational details of the embodiment of FIGS. 7–9 are as described above and need not be repeated.

It will be apparent that the modified embodiment of FIGS. 7–9 possesses all of the features and advantages previously set forth with respect to the embodiments of FIGS. 1–6. Moreover, hat-shaped baffle 160 (FIGS. 7–8) has been found to reduce substantially the pressure drop between inlet fitting 32*a* and accumulator chamber 140. More specifically, the combination of baffle 160 with standpipe 94*a* and a slightly enlarged inlet fitting 32*a* has been found to yield a 64% reduction in pressure drop between inlet 32*a* and compressor 14, i.e. a reduction from 1.8 pounds to 0.6 pounds pressure drop as compared with the embodiment described in detail in connection with FIGS. 1–4.

From the foregoing description, it will now be apparent that a refrigerant system and method of operating the same with a compressor-mounted accumulator constructed in accordance with the invention readily satisfies the aforestated objects. It will also be understood that various modifications of the system and apparatus of the invention will be apparent to those skilled in the art without departing from the scope of the invention, which is primarily defined by the appended claims.

I claim:

1. In a gas-liquid separating and liquid storage device for a refrigeration system having a reservoir in which fluid is whirled about an upright axis of said reservoir, an improved gas outlet means disposed centrally of said reservoir comprising an upright tube open at the opposite ends thereof, a cup surrounding at least a portion of said tube and having an open upper end disposed near the upper end of said tube and a bottom wall joined in sealed relation to the exterior of said tube, said bottom wall having at least one liquid metering orifice extending therethrough and a cap mounted on the upper end of said cup, said cup having a top wall overlying the upper end of said tube in spaced relation therefrom with a pressure equalizing vent in said top wall communicating with the space over said tube upper end, said cap also having a sleeve dependent therefrom extending into the annular space defined between said tube and cup with the lower end of said sleeve spaced above said cup bottom wall, said cap top wall having inlet means for communicating the reservoir with the annular space defined between said cup and said cup sleeve, the lower end of said tube serving as the gas exit from said reservoir.

2. The combination set forth in claim 1 wherein said cap sleeve extends downwardly from said cap top wall for at least three-quarters of the height of said cup.

3. The combination set forth in claim 1 wherein said cap top wall has a groove in the undersurface thereof extending circumferentially about said cap sleeve and receiving the upper end of said cup with a snap-on engagement.

4. The combination set forth in claim 3 wherein said inlet means of said cap top wall comprises a circular row of holes communicating via said groove with said annular space defined between said cup and said cap sleeve.

5. The combination set forth in claim 1 wherein said bottom wall internally of said cup comprises at least on upwardly sloping surface in the region of said at least one liquid metering orifice with said at least one liquid metering orifice opening interiorly of said cup adjacent an upper portion of said surface.

* * * * *